United States Patent [19]

Lytton et al.

[11] 4,154,485

[45] May 15, 1979

[54] WEB-FORMER

[75] Inventors: Kenneth G. Lytton, Gastonia; George J. Miller, Dallas; James E. Donnelly, Gastonia, all of N.C.

[73] Assignee: Fiber Controls Corporation, Gastonia, N.C.

[21] Appl. No.: 825,053

[22] Filed: Aug. 16, 1977

[51] Int. Cl.[2] ..... B65G 53/40

[52] U.S. Cl. ..... 406/70; 19/105; 406/23; 406/156; 406/159; 406/163

[58] Field of Search ..... 302/28, 59; 19/105

[56] References Cited

U.S. PATENT DOCUMENTS

| | | | |
|---|---|---|---|
| 3,284,140 | 11/1966 | Reiterer | 302/59 |
| 3,439,838 | 4/1969 | Wise | 222/57 |
| 3,605,196 | 9/1971 | Wise et al. | 19/83 |
| 3,671,078 | 6/1972 | Wise | 302/28 |
| 3,750,235 | 8/1973 | Wise | 19/105 |
| 3,762,772 | 10/1973 | Fuss | 302/28 |
| 3,901,555 | 8/1975 | Wise | 302/28 |
| 3,930,285 | 1/1976 | Wornall | 19/105 X |
| 4,009,803 | 3/1977 | Lytton et al. | 19/105 X |
| 4,045,091 | 8/1977 | Beneke | 302/28 |

*Primary Examiner*—Robert B. Reeves
*Assistant Examiner*—James L. Rowland
*Attorney, Agent, or Firm*—Cushman, Darby & Cushman

[57] ABSTRACT

A system and apparatus for forming webs from textile fibers entrained in an air stream in a conduit with a perforated plate dividing the interior of a housing into first and second chambers so that the entrained fibers fall to the bottom of the first chamber and the air passes through the plate while a portion of the plate is oscillated. The passage between the conduit and first chamber increases in cross-section from conduit to first chamber to reduce the velocity of the air and entrained particles.

23 Claims, 3 Drawing Figures

WEB-FORMER

BRIEF DESCRIPTION OF THE INVENTION BACKGROUND AND SUMMARY OF THE INVENTION

The invention relates to an improved apparatus and system for feeding fibers to a carding machine or the like.

Devices for feeding a web of uniform density and thickness to a card are commonly referred to as web-formers. In modern textile processing plants fibers are delivered to the web-formers, entrained in a stream of air. The air and entrained fibers are separated from one another in the web-former. For example, in U.S. Pat. No. 3,750,235, a web-former is described which uses rolls to feed fibers onto a spiked inclined apron. The fibers are transported upwardly on the spike apron which drops them down a shaft. The shaft is formed by a front wall and a shaker plate at least one of which contains a multiplicity of small perforations. The shaker plate presses the fibers introduced into the shaft thereby expressing air from the fibers through those perforations and moves the fibers downwardly to an outlet opening for feeding the fibers to subsequent textile equipment, particularly to a card.

U.S. Pat. No. 4,009,803 describes another web-former of this type with several improvements, and in which an eccentric bearing driven by a shaft which is in turn driven by a motor oscillates a shaker plate. The shaker plate divides the interior of the web-former into first and second chambers. The entrained fibers are directed by doffers into the first chamber where the air passes through perforations in the first chamber and/or a perforated height extending chamber thereabove and the fibers accumulate in the first chamber. The oscillating movement of the shaker causes the fibers to become compacted in the lower part of the first chamber, from which they are continuously removed by means of rollers or the like to form the uniform web which can then be fed to a card. A sensor is provided in at least some of the web-formers of the system for detecting the level of fibers in the first chamber. According to a prior art improvement of the system of U.S. Pat. No. 4,009,803, in at least some of the web-formers, the upper portion of the perforated plate is centrally blocked, and the doffers are eliminated so that fibers do not accumulate in the blocked upper portion of the first chamber.

One of the difficulties with the improved web-former as described above with a blocking plate is that the velocity of air passing through the perforated plate varies greatly over its surface. The velocity peaks near the blocking plate and drops by half or more towards the edge of the shaker plate. This causes problems in satisfactorily causing the fibers to be disentrained from the air and can further lead to some of the fibers blocking the perforations, rather than falling to the bottom of the first chamber.

Another difficulty is that it is desirable to entrain the fibers in the system at a high velocity. Velocities of 1400 to 1500 feet per minute are needed to keep synthetic fibers suitably moving in the middle of the conduit regardless of the size of the conduit. While natural fibers such as cotton will work at lower velocities, it is desirable to maintain sufficient flexibility in the system to be able to operate with either synthetic or natural fibers.

However, with the prior art systems described above, operation at such high velocities was not satisfactory. The fibers have a tendency at such speeds to matt at the perforated plate.

According to the present invention, the above problems are overcome in a web-former of the type having a perforated shaker plate dividing the interior of the web-former into first and second chambers by providing a passage between the conduit which carries the fibers and the first chamber, which passage increases in cross-section in the direction from the conduit to the first chamber. By increasing the cross-sectional area in the passage, the velocity of the fibers is reduced. At the same time the velocity in the conduit can be high enough to satisfactorily transport synthetic fibers. The reduced velocity fibers which enter the first chamber will satisfactorily fall to the bottom thereof and can be used to form the web. The above-mentioned problem of matting is thereby resolved.

Many other objects and purposes of the invention will be clear from the following detailed description of the drawings.

BRIEF DESCRIPTION OF THE DRAWINGS

FIG. 1 shows a perspective view of the system of this invention for feeding fibers to a plurality of conventional cards or the like;

DETAILED DESCRIPTION OF THE DRAWINGS

Figure 1:
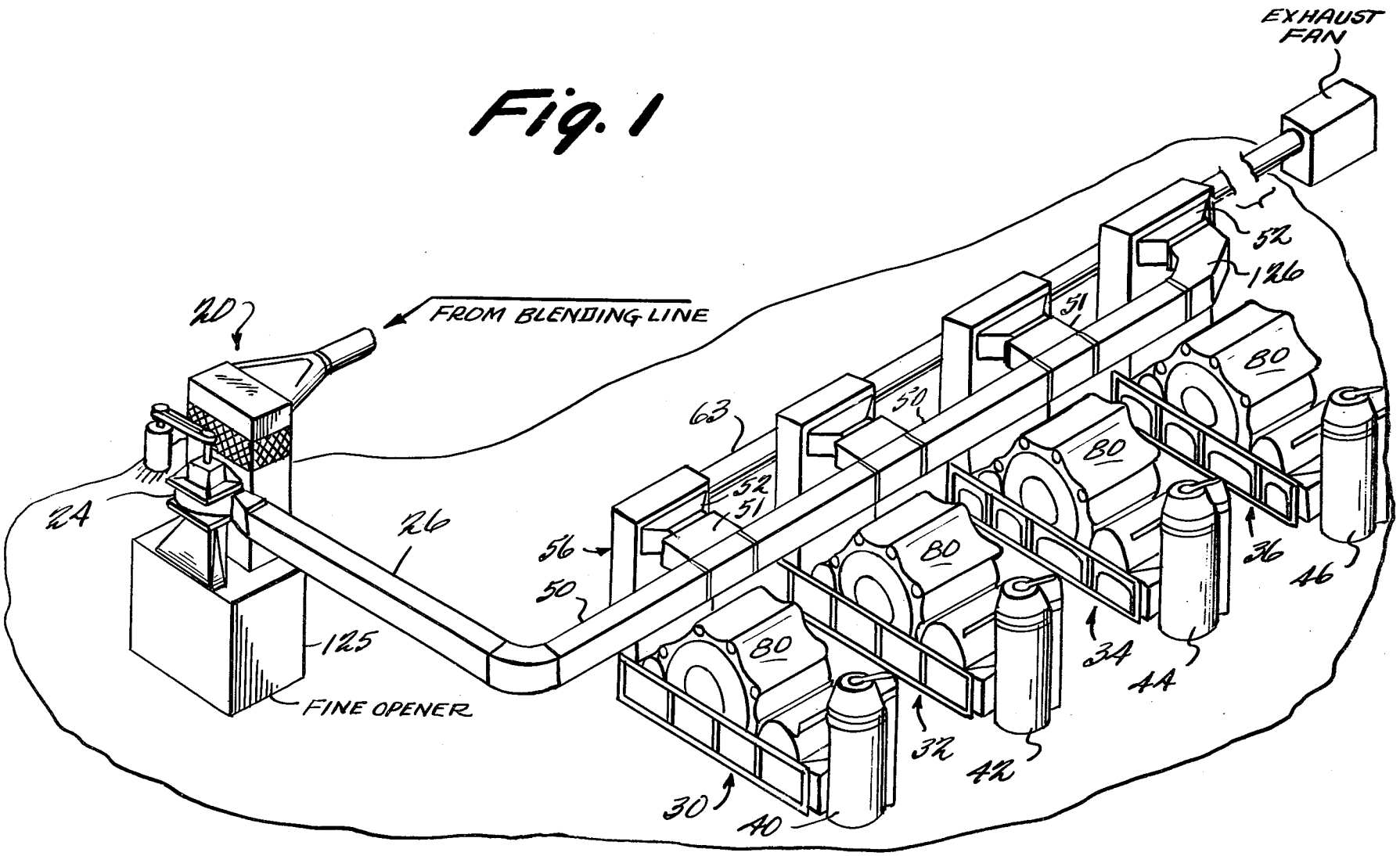

Reference is now made to FIG. 1 which illustrates an overall schematic view of the novel system of the present invention. Fiber material such as relatively dense fibers, for example, pima cotton, nylon or bleached cotton from a blending line or the like are delivered to a fine opener assembly 20 which includes a fan or blower 24 for producing positive air pressure, a conventional beater (not shown), and feed rolls for supplying fibers to the beater from a reserve chute (not shown). The individual fibers from the blending line are entrained in a stream of air generated by blower 24 and passed within conduit 26 to a plurality of conventional card machines. In the embodiment of FIG. 1, cards 30, 32, 34 and 36 together with associated coilers 40, 42, 44 and 46 are illustrated. It is, of course, understood that the system is not limited to any particular number of card machines and that the number of card machines can be adjusted in accordance with the desired output of the system and the amount of fiber which can be delivered by conduit 26 and the fine opener assembly 20. Suitable opener assemblies and blender lines are commercially available. One blending line, for example, is discussed and described in detail in U.S. Pat. No. 3,439,838.

Figure 2:
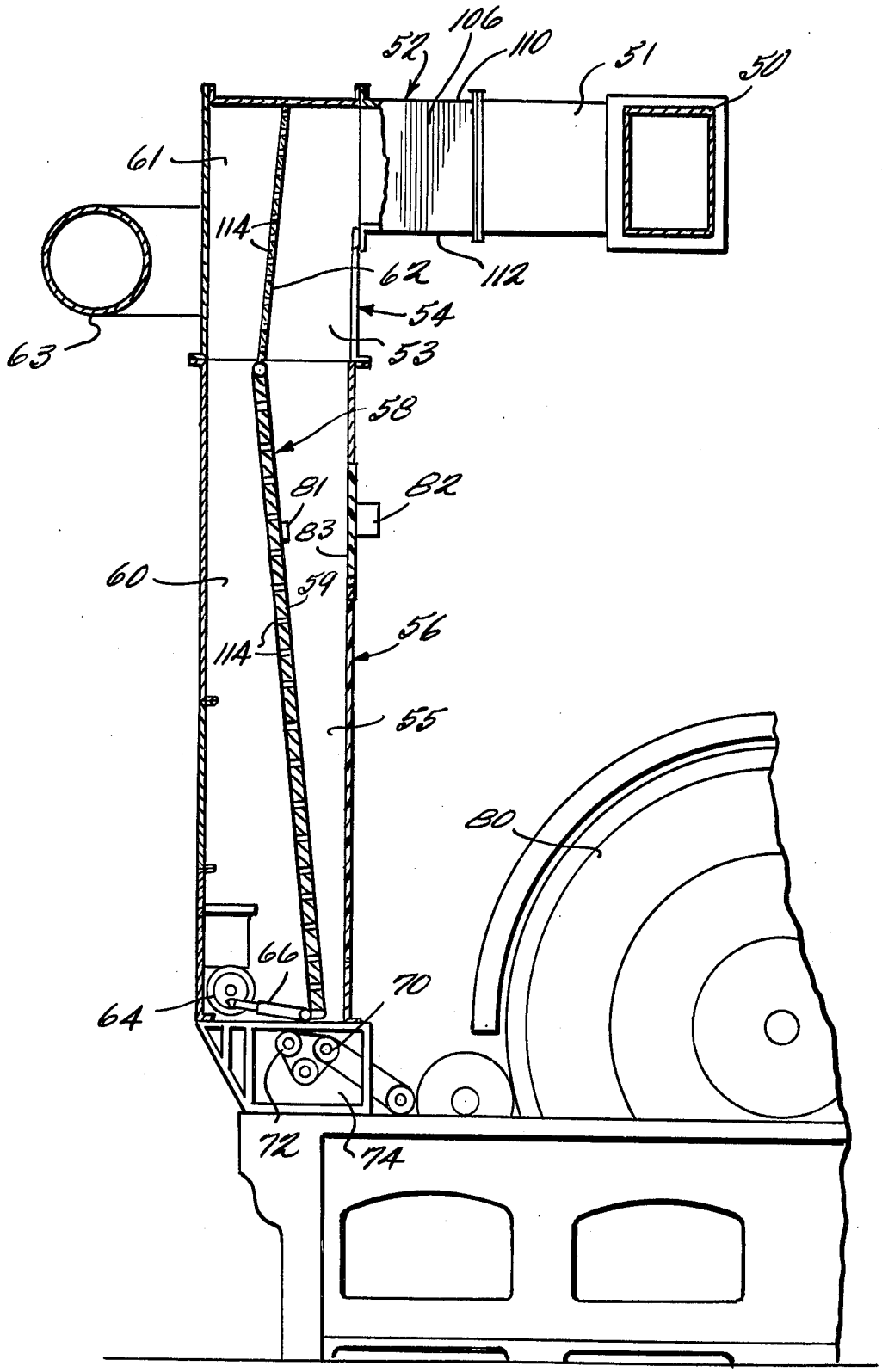
FIG. 2 shows a partial sectional view of the improved web-former of the present invention.
Figure 3:
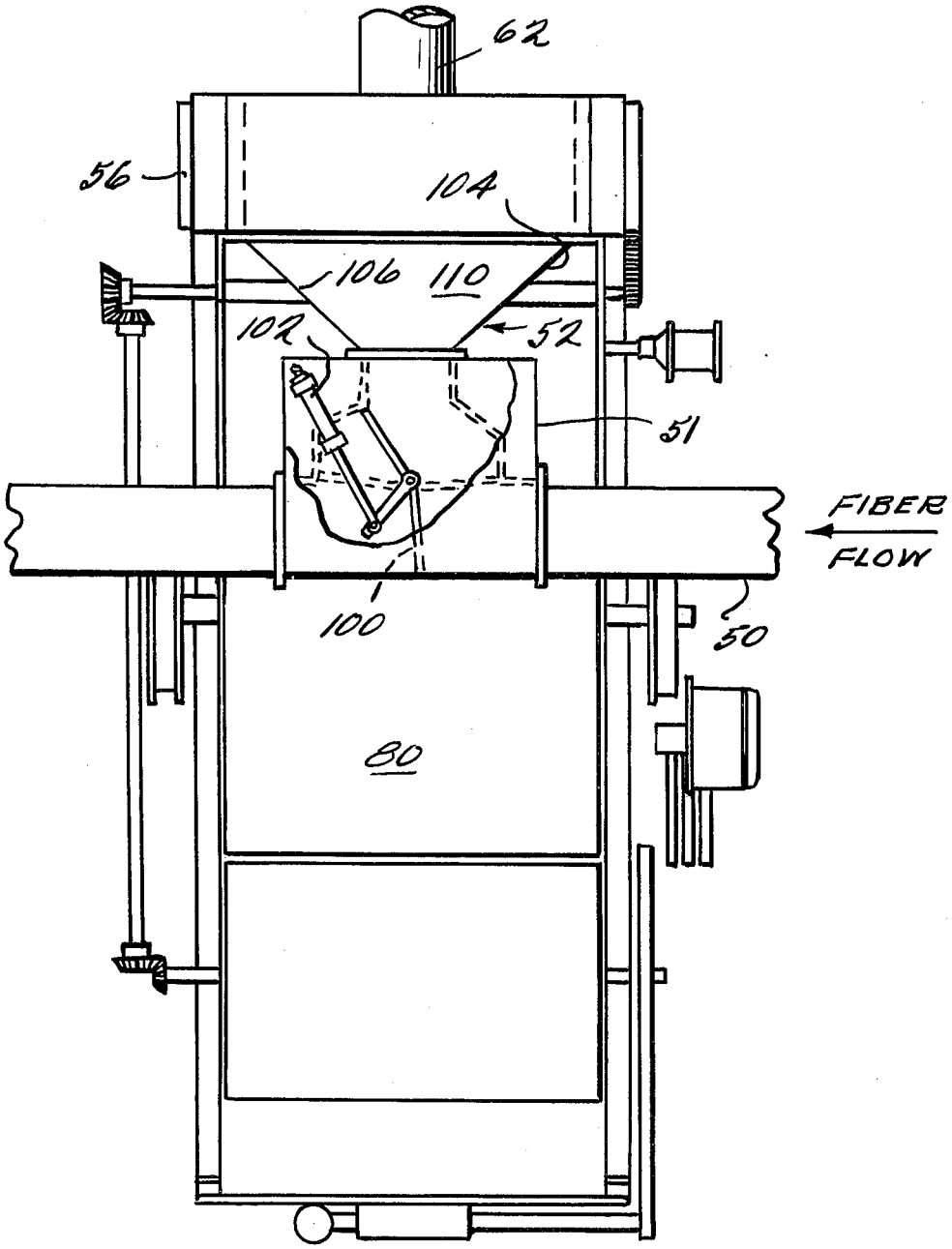
FIG. 3 shows a vertical sectional view of the web-former of the present invention.

Reference is now made to FIGS. 2 and 3 which illustrate a sectional view and a top view of one embodiment of the web-former of the present invention. The web-former of the present invention is generally similar to the web-former disclosed in U.S. Pat. No. 4,009,803 discussed above, with the differences which are noted above and which will be discussed in detail below. Accordingly, the disclosure of issued U.S. Pat. No. 4,009,803 is hereby incorporated into the present application by reference.

An air stream with textile fibers entrained therein passes along conduit 50 which is mounted adjacent a number of the web-formers. As can be seen in FIGS. 2 and 3, a valved passage 51 and flared transition 52 connect conduit 50 to a first or front chamber within the housing 56 of the web-former. That front chamber includes an upper section 53 in air box 54 and a lower section 55 in the shaker chute. Perforated plate means 58 includes a lower portion or shaker plate 59, which is oscillated about a pivot point at its upper end, and a fixed upper portion 62, the lower end of which is adjacent the pivot point of the shaker plate 59. Perforated plates 59 and 62 divide the interior space into the above-mentioned front chamber and a second or rear chamber having a lower section 60 and an upper section 61. The stationary perforated plate 62 serves to pass much of the air, but deflects downward the entrained fibers which enter chamber 53 from conduit 50. Air still in the deflected fibers is squeezed out into the rear chamber section 60 by the oscillation of shaker plate 59, and the air therefrom and from the upper rear chamber section 61 is removed through an exhaust line 63 connected to an exhaust system. The deflected fibers separated from the air fall toward the bottom of chamber 55 where they are compacted into a web.

The shaker plate 59 is oscillated by a motor 64 eccentrically connected to the oscillating bottom portion of plate 59 by linkage 66. The compacted fibers which accumulate in the chamber 55 are delivered therefrom as a web by rollers 70, 72, and 74 in a well-known fashion, to a conventional card 80. An electric control device 82 is mounted for detecting the level of fibers in the first chamber to prevent overfeeding of the same. Any suitable electrical or optical sensor can be used and several such devices are commercially available. Preferably device 82 is a combination light source and electric eye which receives reflections from mirror 81 through plastic portion 83. The electrical control is coupled to a conventional control circuit which controls operation of a flapper valve 100 which can be seen best in FIG. 3. Valve 100 is shifted between the illustrated open position and a closed position as shown in dashed lines by means of a conventional piston 102. In the open position, the flap valve 100 diverts flow of the air and entrained fibers into the flared transition passage 52.

As has been indicated, the conduit includes between valve 100 and the front chamber section 53 a flared transition portion 52 in which the cross-sectional area of the passage is greatly increased to significantly decrease the velocity of the air and entrained fibers, thereby eliminating the problems noted above. Referring to FIG. 3, opposite walls 104 and 106 which extend in the vertical plane diverge from each other while walls 110 and 112 as shown in FIG. 2 extend in parallel. For example, the passage diverges from a 9 inch width between walls 104 and 106 at the location adjacent the valve 100 to a 3 foot width at the point of entry into air box 54. This flare occurs, for example, in a length of 12 inches. With regard to perforated plate 62 and also shaker plate 59, ⅛ inch holes 114 on 3/16 inch staggered centers have been found to be satisfactory.

Continuing with the example, the width of the entry of air box 54 is also 3 feet, but the height of air box 54 is twice the height of flared transition 52, i.e., the front chamber section 53 is about 2 feet. As further exemplary dimensions, the sloping perforated plate 62 is disposed to make the front to rear depth of chamber section 53 about 7½ inches at its upper end and about 9½ inches at its lower end.

A feature of this invention is not only to reduce the velocity of the air and entrained fibers greatly by the flared transition, but to keep that velocity reduced by the largeness of chamber section 53 and the upper opening of chamber section 55. In this manner, the fibers drop out of the main airstream which continues on through perforations 114 in plate 62 to exhaust pipe 63.

Using this invention, it has been found that the fibers spread quite evenly across the width (from side to side) of the front chamber section 53 and drop evenly across the lower chamber section 55 without matting on the deflector plate 62. In fact, measurements of air exiting holes 114 in plate 62 have shown much improved uniformity across the width thereof, e.g., 425±25 F.M. (feet per minute), with an input to conduit 50 of about 1400 F.M. as caused by blower 24. This uniformity is in contrast to a prior arrangement which had no flared transition but the air entrained fibers hit a solid central part (blocking plate) of a deflector otherwise similar to perforated plate 62 and in which the velocity of air behind the prior plate peaked near the solid central part at about 1000 F.M. and reduced to about 500 F.M. towards the edges.

In the present system, the exhaust conduit 63 is connected to a fan which helps keep the air moving through the system at at least the same velocity effected by blower fan 24; for example, the exhaust fan is driven at 1500 F.M. as compared to 1400 F.M. for blower 24 to help pull "lazy" or stuck fibers along. Both blower 24 and the exhaust fan are maintained continuously in the "on" position and sensors 82 not only operate the respective valves 51 but also control the feed rolls in the fine opener 125 (which may be similar to the opener in U.S. Pat. No. 3,605,196) adjacent the blower, preferably by serial scanning of the condition of detectors 82, e.g., as in U.S. Pat. Nos. 3,671,078 or 3,901,555. The last chute in line needs no valve section 51 (nor sensor 82) but instead as shown in FIG. 1, section 126 of the input conduit 50 is twice angled at 45° to connect with its flared transition 52. The amount of fibers fed down the line is never enough to overload the last chute significantly if at all.

As earlier mentioned, in order to keep synthetic fibers moving through the conduit 50 from beginning to end, velocities of 1400 to 1500 F.M. have been found to be necessary. Without the flared transition 52 and continued velocity reduction effected in chamber section 53, prior chute feeds could not handle cards which were increased in speed so as to produce 100 lbs./hr. which it has been found requires a 1400–1500 F.M. velocity from fan 24 to supply sufficient fibers of either the synthetic or natural kind. At such a high input velocity, the flared transition reduces the velocity at each requesting chute by at least half, preferably to less than 700 F.M. and more preferably down to 400–450 F.M., uniformly across the rear of plate 62 so that the fibers will drop from chamber section 53 with an even spread across chamber section 55.

Many changes and modifications in the above-described embodiment of the invention can, of course, be carried out without departing from the scope thereof. Accordingly, that scope is intended to be limited only by the scope of the appended claims.

What is claimed is:

1. A system for delivering textile fibers to a plurality of textile machines comprising:

a conduit;

means for supplying a stream of air with textile fibers entrained therein to said conduit;

a plurality of web-formers each connected to said conduit for removing fibers from said conduit and forming a web of said fibers, each web-former including:

a vertically disposed housing having a plurality of walls including vertical walls defining a substantially closed interior space, one of said vertical walls having near its upper end an air-fiber inlet opening, another of said vertical walls having an air outlet, perforated plate means with at least a portion mounted for oscillatory movement and dividing said interior space into a first chamber and a second chamber respectively having said inlet and outlet openings, means defining a passage having one end adapted to receive said air entrained fibers from said conduit and an opposite end connected to said inlet opening so that air with textile fibers therein passes into said first chamber and the air then into said second chamber through said perforated plate means and out said outlet opening, leaving the fibers in said first chamber, said passage having a flared transition portion with a cross-sectional area which increases in the direction from said conduit to said first chamber so as to reduce the velocity of the air with fibers entrained therein and so that the fibers fall downwardly in said first chamber and the velocity of the air passing through said perforated plate means is substantially uniform over the surface of said plate; and valve means mounted in said passage upsteam of said flared transition portion for movement between a closed position blocking movement of air with textile fibers entrained therein through said passage and an open position causing movement thereof through said passage.

2. A system as in claim 1 including means for oscillating at least a portion of each said plate means.

3. A system as in claim 1, including means for positively exhausting air from each said second chamber via said air outlets.

4. A system as in claim 1, including a plurality of rollers at the bottom of said first chamber for forming a web of textile material.

5. A system as in claim 1, wherein said passage defining means includes four walls, two opposing walls extending in parallel to each other and two walls diverging from each other.

6. A system as in claim 1, wherein said valve means includes a flapper valve and mans for pivoting said valve between a position diverting flow into said first chamber and a position closing said passage.

7. A web-former for removing fibers from a conduit carrying a stream of air with textile fibers entrained therein and forming a web of said fibers, comprising:

a vertically disposed housing having a plurality of walls including vertical walls defining a substantially closed interior space, one of said vertical walls having near its upper end an air-fiber inlet opening, another of said vertical walls having an air outlet opening, perforated plate means with at least a portion mounted for oscillatory movement and dividing said interior space into a first chamber and a second chamber respectively having said inlet and outlet openings, means defining a passage having one end adapted to receive said air entrained fibers from said conduit and an opposite end connected to said inlet opening so that air with textile fibers therein passes into said first chamber and the air then into said second chamber through said perforated plate means and out said outlet opening, leaving the fibers in said first chamber, said passage having a flared transition portion with a cross-sectional area which substantially increases in the direction of air-fiber flow toward said first chamber so as to reduce the velocity of the air with fibers entrained therein and so that the fibers fall downwardly in said first chamber and so that the velocity of the air passing through said perforated plate means is substantially uniform over the surface of said plate, and valve means mounted in said passage upstream of said flared transition portion for movement between a closed position blocking movement of air with textile fibers entrained therein through said passage and an open position causing movement thereof through said passage.

8. A web-former as in claim 7, including means for oscillating a portion of said plate.

9. A web-former as in claim 7, including means for exhausting air from said second chamber.

10. A web-former as in claim 7, including a plurality of rollers at the bottom of said first chamber and forming a web of textile material.

11. A web-former as in claim 7, wherein said passage defining means includes four walls, two opposing walls extending in parallel to each other and two walls diverging from each other.

12. A web-former as in claim 7, wherein said valve means includes a flapper valve and means for pivoting said valve between a position diverting flow into said first chamber and a position closing said passage.

13. A web-former for removing fibers from a conduit carrying a stream of air with textile fibers entrained therein and forming a web of said fibers, comprising:

a vertically disposed housing having a plurality of walls including vertical walls defining a substantially closed interior space, one of said vertical walls having near its upper end an air-fiber inlet opening, another of said vertical walls having an air outlet opening, vertically disposed plate means having upper and lower ends and dividing said interior space into a first chamber having said inlet opening and a second chamber having said outlet opening, a part of the vertical length of said plate means being a shaker plate having a pivoted upper end disposed a given distance downward from the said upper end of said plate means and having a lower end forming the said lower end of said plate means, said plate means containing a multiplicity of air holes, means for oscillating said shaker plate about its said upper end, means defining a passage having one end for receiving said air entrained fibers from said conduit and an opposite end connected to said inlet opening for delivering said air entrained fibers into the upper end of said first chamber and against the said upper end of said plate means, said passage means having a flared transition portion with a cross-sectional area which substantially increases in the direction of air-fiber flow toward said first chamber so as to substantially reduce the velocity of the air entrained fibers as they reach said housing inlet opening, the upper end of said first chamber being of such size to maintain the air entrained fibers reduced so that the fibers readily deflect from said plate means downwardly in said first chamber and the air passes into said second chamber via the said air holes in said plate means without matting said plate means while said oscillating shaker plate forms said web at its said lower end, and valve means upstream of said flared transition portion for movement between a closed position blocking movement of air entrained fibers from said conduit through said passage and an open position causing movement thereof through said passage.

14. A web-former as in claim 13 wherein said housing includes an air box forming the upper portion of said housing and connected thereto a chute forming the lower portion of said housing, and wherein the height of said air box is approximately twice the height of said flared transition portion of said passage means, said flared transition portion being of substantially constant height along its length, said plate means being so disposed in said air box that in conjunction with the height of the air box the velocity as reduced by said flared transition portion remains reduced in the first chamber portion of said air box, at least the lower part of the plate means in said air box being perforated with a multiplicity of said air holes across its width.

15. A web-former as in claim 14 wherein said plate means in said air box has a vertical slope with its upper end forming a shorter cross-sectional length of said first chamber than its lower end in said air box.

16. A web-former as in claim 14 wherein the height of said air box is approximately the same as the said given distance at which said shaker plate is pivoted downward from the upper end of said plate means, said shaker plate being generally disposed to converge said front chamber below said air box.

17. A web-former as in claim 13 having means including said conduit for blowing said air entrained fibers through said conduit to said valve means at a high velocity, said flared transition portion having such an increased cross-sectional area as to reduce said velocity by at least half.

18. A web-former as in claim 17 wherein the air entrained fibers are moved through said conduit at a velocity of at least in the area of about 1400 feet per minute.

19. A web-former as in claim 18 including air exhaust means connected to said air outlet opening for creating a suction having a velocity at least as high as the velocity of said air entrained fibers in said conduit.

20. A web-former as in claim 19 including means for sensing when said first chamber is filled with fibers to a given height for closing said valve means when the fibers exceed that height and opening the valve means when the fiber level is below that height, said blowing means including a blower fan and a fiber source, said exhaust means including an exhaust fan, both of said fans being maintained continuously on, said sensing means being also operative to turn said fiber source means on and off concurrently with said valve means.

21. A system for delivering textile fibers to a plurality of textile machines comprising:

a plurality of web-formers each constructed according to claim 19 and commonly sharing said conduit for receiving the air entrained fibers and commonly sharing said air exhaust means.

22. A system for delivering textile fibers to a plurality of textile machines comprising:

a line of web-formers each except the last in line being constructed according to claim 19 and all commonly sharing said conduit and exhaust means, the said last web-former being constructed substantially like the others but absent said valve means.

23. A web-former for removing fibers from a conduit carrying a stream of air with textile fibers entrained therein and forming a web of said fibers, comprising:

a vertically disposed housing having a plurality of walls including vertical walls defining a substantially closed interior space, one of said vertical walls having near its upper end an air-fiber inlet opening, another of said vertical walls opposite said one wall having an air outlet opening, vertically disposed plate means having upper and lower ends and dividing said interior space into a first chamber having said inlet opening and a second chamber having said outlet opening, at least a part of the vertical length of said plate means being a shaker plate having a pivoted upper end and having a lower end forming the said lower end of said plate means, said plate means containing a multiplicity of air holes, means for oscillating said shaker plate about its said upper end, means defining a passage having one end for receiving said air entrained fibers from said conduit and an opposite end connected to said inlet opening for delivering said air entrained fibers into the upper end of said first chamber and against the said upper end of said plate means, said passage means having a flared transition portion with a cross-sectional area which substantially increases in the direction of air-fiber flow toward said first chamber so as to substantially reduce the velocity of the air entrained fibers as they reach said housing inlet opening, the upper end of said first chamber being of such size to maintain the air entrained fibers reduced so that the fibers readily deflect from said plate means downwardly in said first chamber and the air passes into said second chamber via the said air holes in said plate means without matting said plate means while said oscillating shaker plate forms said web at its said lower end, and valve means upstream of said flared transition portion for movement between a closed position blocking movement of air entrained fibers from said conduit through said passage and an open position causing movement thereof through said passage.

* * * * *